US007367164B2

(12) United States Patent
Burton et al.

(10) Patent No.: US 7,367,164 B2
(45) Date of Patent: May 6, 2008

(54) LOW-PROFILE FLASH PAN

(75) Inventors: Christopher A. Burton, Cornelius, NC (US); Mike Minigh, Clemons, NC (US)

(73) Assignee: Moisture Warranty Corporation, Cornelius, NC (US)

( * ) Notice: Subject to any disclaimer, the term of this patent is extended or adjusted under 35 U.S.C. 154(b) by 85 days.

(21) Appl. No.: 10/995,974

(22) Filed: Nov. 23, 2004

(65) Prior Publication Data

US 2006/0107604 A1 May 25, 2006

(51) Int. Cl.
*E06B 7/14* (2006.01)

(52) U.S. Cl. ..... 52/209; 52/302.6

(58) Field of Classification Search ..... 52/209, 52/302.6, 62, 58, 60, 61, 302.1; 404/2, 4; 405/43, 45; 49/471; 119/450
See application file for complete search history.

(56) References Cited

U.S. PATENT DOCUMENTS

| | | | | |
|---|---|---|---|---|
| 304,183 | A * | 8/1884 | Davis | 52/97 |
| 1,954,730 | A * | 4/1934 | Erickson | 52/302.1 |
| 3,638,372 | A * | 2/1972 | Rosenthal | 52/97 |
| 5,822,933 | A * | 10/1998 | Burroughs et al. | 52/209 |
| 5,921,038 | A * | 7/1999 | Burroughs et al. | 52/209 |
| 6,098,343 | A | 8/2000 | Brown et al. | |
| 6,119,416 | A | 9/2000 | Larson | |
| 6,293,064 | B1 * | 9/2001 | Larson | 52/302.1 |
| 6,385,825 | B1 | 5/2002 | Wark | |
| D517,225 | S * | 3/2006 | Burton et al. | D25/123 |
| 7,059,087 | B2 * | 6/2006 | Allen | 52/58 |
| 2005/0055912 | A1 * | 3/2005 | Teodorovich | 52/209 |
| 2005/0097837 | A1 * | 5/2005 | Burton | 52/204.1 |

* cited by examiner

*Primary Examiner*—Robert Chilcot
*Assistant Examiner*—Adriana Figueroa
(74) *Attorney, Agent, or Firm*—Schwartz Law Firm P.C.

(57) ABSTRACT

A flash pan is adapted for collecting and distributing water infiltrating a building at an access opening. The flash pan includes a low-profile base designed to reside beneath the access opening. The base has opposing longitudinal inside and outside edges, opposing lateral end edges, and top and bottom major surfaces. A plurality of feeder channels are formed with the top major surface of the base, and extend from the inside edge towards the outside edge. A longitudinal collection channel is formed between the inside and outside edges of the base. The collection channel communicates with the plurality of feeder channels for receiving water collected by the feeder channels. A drain channel communicates with the collection channel, and extends outwardly towards the outside edge of the base. Water collecting in the feeder channels flows to the collection channel, and is distributed away from the base through the drain channel.

9 Claims, 6 Drawing Sheets

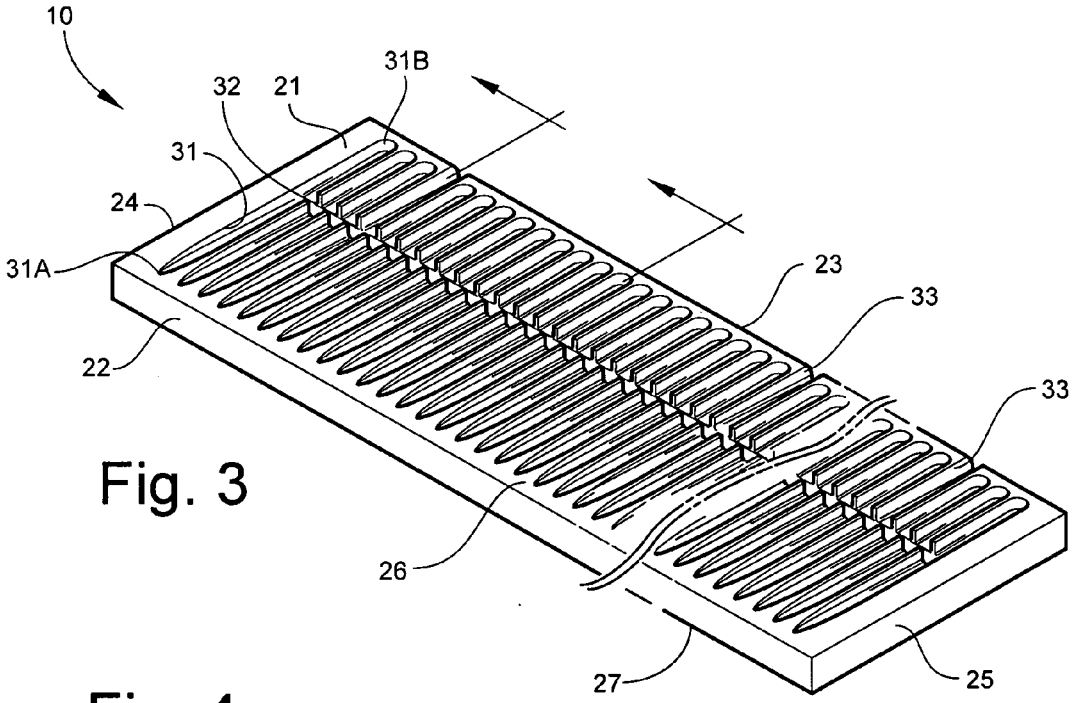
Fig. 3
Fig. 4
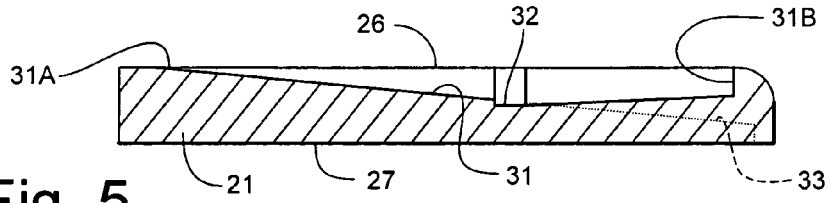
Fig. 5
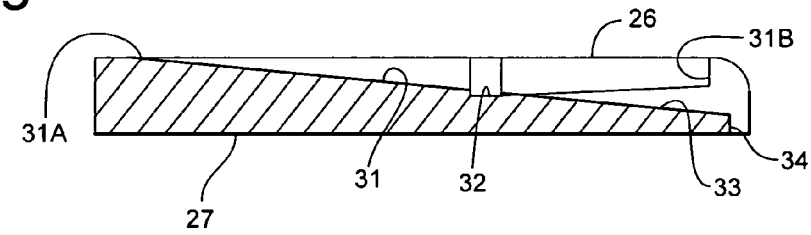

LOW-PROFILE FLASH PAN

TECHNICAL FIELD AND BACKGROUND OF THE INVENTION

This invention relates to a low-profile flash pan for managing water infiltration into buildings, and more specifically, water infiltration between exterior cladding and windows. The present system is especially applicable for installation in residential homes and other light-frame structures. Generally, these buildings have increased potential for moisture problems due to energy-efficient construction techniques which emphasize a low level of air leakage. The problems are especially prevalent in colder climates. For these structures, the most effective way to control excessive moisture is to maintain a reasonable level of indoor humidity. In warmer southern climates, problems more often result from moisture coming in from the outside rather than the indoor humidity being too high. This moisture often becomes trapped within the wall cavities. Excessive moisture can decay wood if the moisture remains for extended periods at temperatures greater than approximately 50 degrees F.

According to the National Home Builders Association, the most frequent source of water intrusion is windows. Water frequently enters window locations in two ways—either at the joint around the perimeter of the window, or through seams and joints in the window construction itself. As a first line of defense, builders caulk joints in and around the windows, and install flashing intended to divert water flow away from these interstices. Homeowners are then advised to frequently and thoroughly inspect the windows, flashing, and sealant/caulk. Any damaged flashing should be repaired or replaced immediately. Any cracked or deteriorated sealants should be immediately repaired or removed and replaced. It is also recommended that periodic moisture testing be done to check for any potential problem areas.

The reality for most homeowners is a general failure to consistently inspect and properly maintain windows. Moreover, because the location of water entry is often difficult to see, any damage occurring behind the exterior cladding frequently cannot be detected by visual inspection. If undetected or ignored, continued water intrusion will ultimately damage building sheathing and wood structural members. In addition to this physical damage, moisture problems in the home are being linked to personal injury based on the severe allergic reactions some people have to molds that grow in moistened areas inside the walls.

SUMMARY OF INVENTION

Therefore, it is an object of the invention to provide a low-profile flash pan for managing water infiltration at windows, doors, and other openings. The system is especially applicable for buildings such as residential homes and other light-frame structures.

It is another object of the invention to provide a low-profile flash pan which can be readily and conveniently installed from either the interior or exterior of the building.

It is another object of the invention to provide a low-profile flash pan which is relatively inexpensive to manufacture.

It is another object of the invention to provide a low-profile flash pan which requires relatively little skill and labor to install.

It is another object of the invention to provide a low-profile flash pan which installs with little if any modification of the horizontal sill support stud (commonly referred to as the "rough sill" or "rough sill").

It is another object of the invention to provide a low-profile flash pan which does not penetrate the interior wall cavity.

It is another object of the invention to provide a low-profile flash pan which is applicable to any exterior cladding system including brick, stucco, vinyl, wood, Masonite, cedar shake, Hardy Plank, and the like.

It is another object of the invention to provide a low-profile flash pan which avoids existing electrical wiring, such as that used for alarm systems.

It is another object of the invention to provide a low-profile flash pan which requires little if any cosmetic or structural repair in or around the window after installation.

It is another object of the invention to provide a method of managing water infiltration in buildings.

It is another object of the invention to provide an improved window frame assembly.

These and other objects of the present invention are achieved in the preferred embodiments disclosed below by providing a flash pan adapted for collecting and distributing water infiltrating a building at an access opening. The term "access opening" refers to any opening in the building made to accommodate windows, doors, vents, and the like. The flash pan includes a low-profile base designed to reside beneath the access opening. The base has opposing longitudinal inside and outside edges, opposing lateral end edges, and top and bottom major surfaces. A plurality of feeder channels are formed with the top major surface of the base, and extend from the inside edge towards the outside edge. A longitudinal collection channel is formed between the inside and outside edges of the base. The collection channel communicates with the plurality of feeder channels for receiving water collected by the feeder channels. A drain channel communicates with the collection channel, and extends outwardly towards the outside edge of the base. Water collecting in the feeder channels flows to the collection channel, and is distributed away from the base through the drain channel.

According to another preferred embodiment of the invention, the collection channel is located between a leading end and a trailing end of each feeder channel.

According to another preferred embodiment of the invention, the feeder channels extend laterally on opposite sides of the collection channel.

According to another preferred embodiment of the invention, the leading and trailing ends of the feeder channels slope inwardly towards the collection channel to promote gravity flow of water into the collection channel.

According to another preferred embodiment of the invention, the base includes a plurality of drain channels communicating with the collection channel, and adapted for distributing water away from the base.

According to another preferred embodiment of the invention, the outside edge of the base defines a drip notch located at an exit end of the drain channel.

According to another preferred embodiment of the invention, the base has a profile height of no more than 0.5 inches.

According to another preferred embodiment of the invention, the collection channel has a depth greater than 33% of a profile height of the base.

According to another preferred embodiment of the invention, the collection channel extends substantially parallel to the inside and outside edges of the base.

According to another preferred embodiment of the invention, the feeder channels extend substantially perpendicular to the collection channel.

According to another preferred embodiment of the invention, the drain channel extends substantially perpendicular to the collection channel.

In yet another embodiment, the invention is a window frame assembly including spaced-apart vertical framing members, and horizontal top and bottom framing members cooperating to define a window opening. A flash pan is adapted for collecting and distributing water infiltrating a building at the window opening. The flash pan includes a low-profile base located within a gap formed beneath the window opening between a window sill and the bottom horizontal framing member. The base has opposing longitudinal inside and outside edges, opposing lateral end edges, and top and bottom major surfaces. A plurality of feeder channels are formed with the top major surface of the base, and extend from the inside edge towards the outside edge. A longitudinal collection channel is formed between the inside and outside edges of the base. The collection channel communicates with the plurality of feeder channels for receiving water collected by the feeder channels. A drain channel communicates with the collection channel, and extends outwardly towards the outside edge of the base. Water collecting in the feeder channels flows to the collection channel and drains from the base through the drain channel.

BRIEF DESCRIPTION OF THE DRAWINGS

Some of the objects of the invention have been set forth above. Other objects and advantages of the invention will appear as the description proceeds when taken in conjunction with the following drawings, in which:

FIG. 3 is an enlarged perspective view of the flash pan;

FIG. 4 is cross-sectional view of the flash pan taken substantially along cut line 4 of FIG. 3;

FIG. 5 is cross-sectional view of the flash pan taken substantially along cut line 5 of FIG. 3;

DESCRIPTION OF THE PREFERRED EMBODIMENT AND BEST MODE

Figure 1:
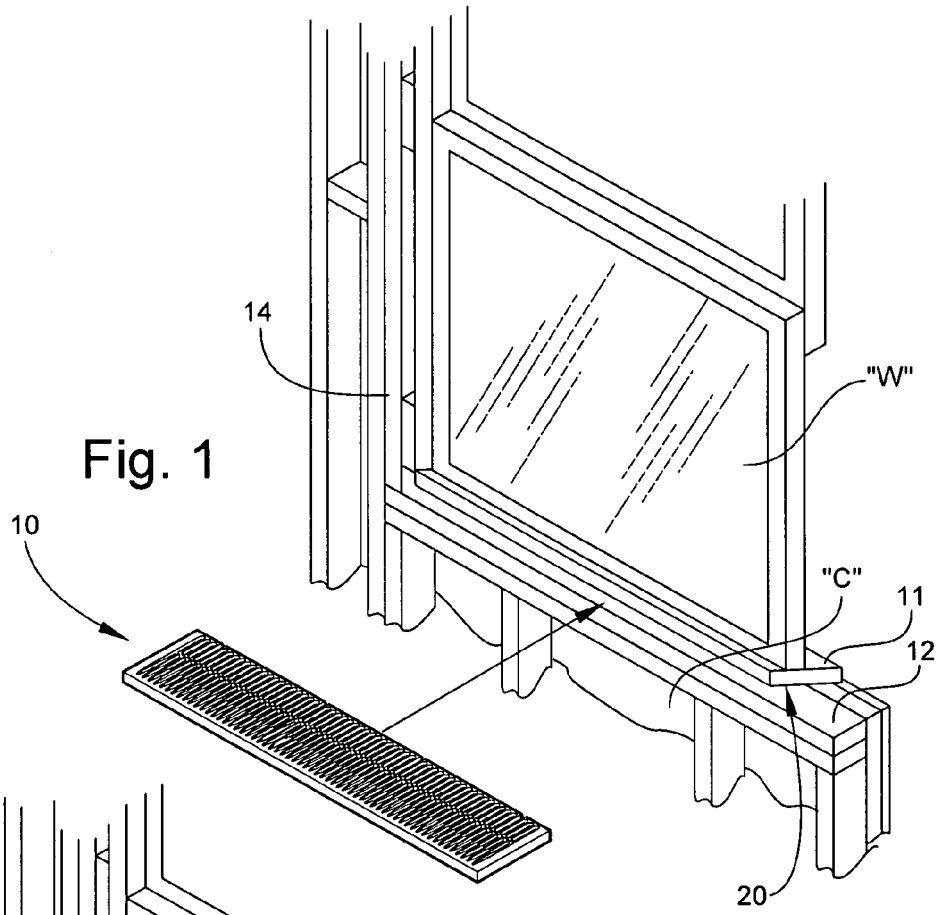
FIG. 1 is a perspective view of a low-profile flash pan according to one preferred embodiment of the present invention, and showing the flash pan prior to installation at the base of a window.
Figure 2:
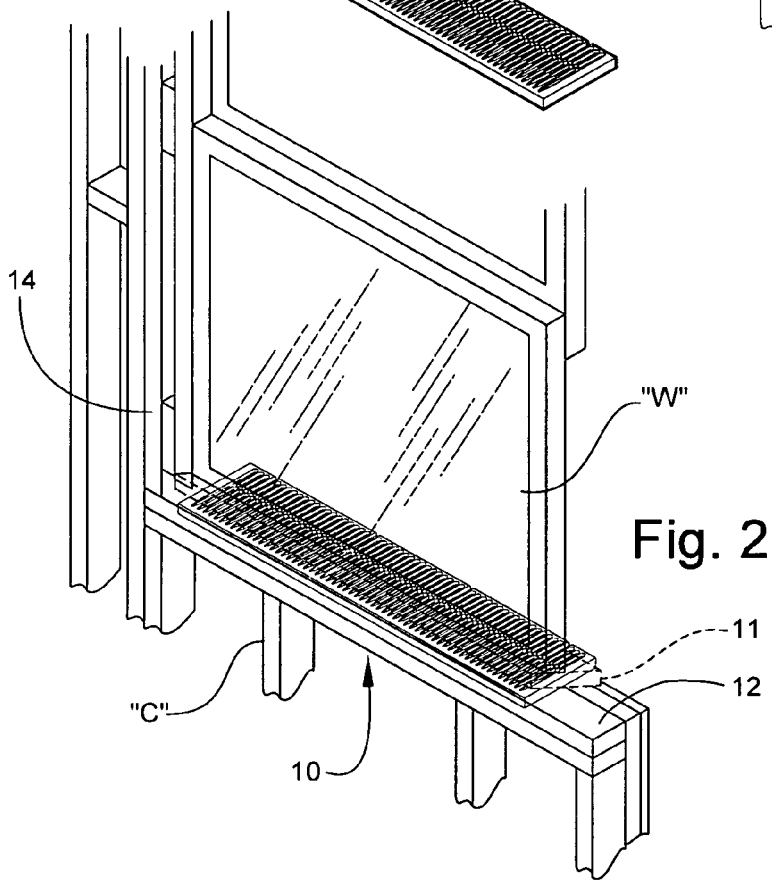
FIG. 2 is a further perspective view of the flash pan after installation, and showing portions of the window frame in phantom.
Figure 6:
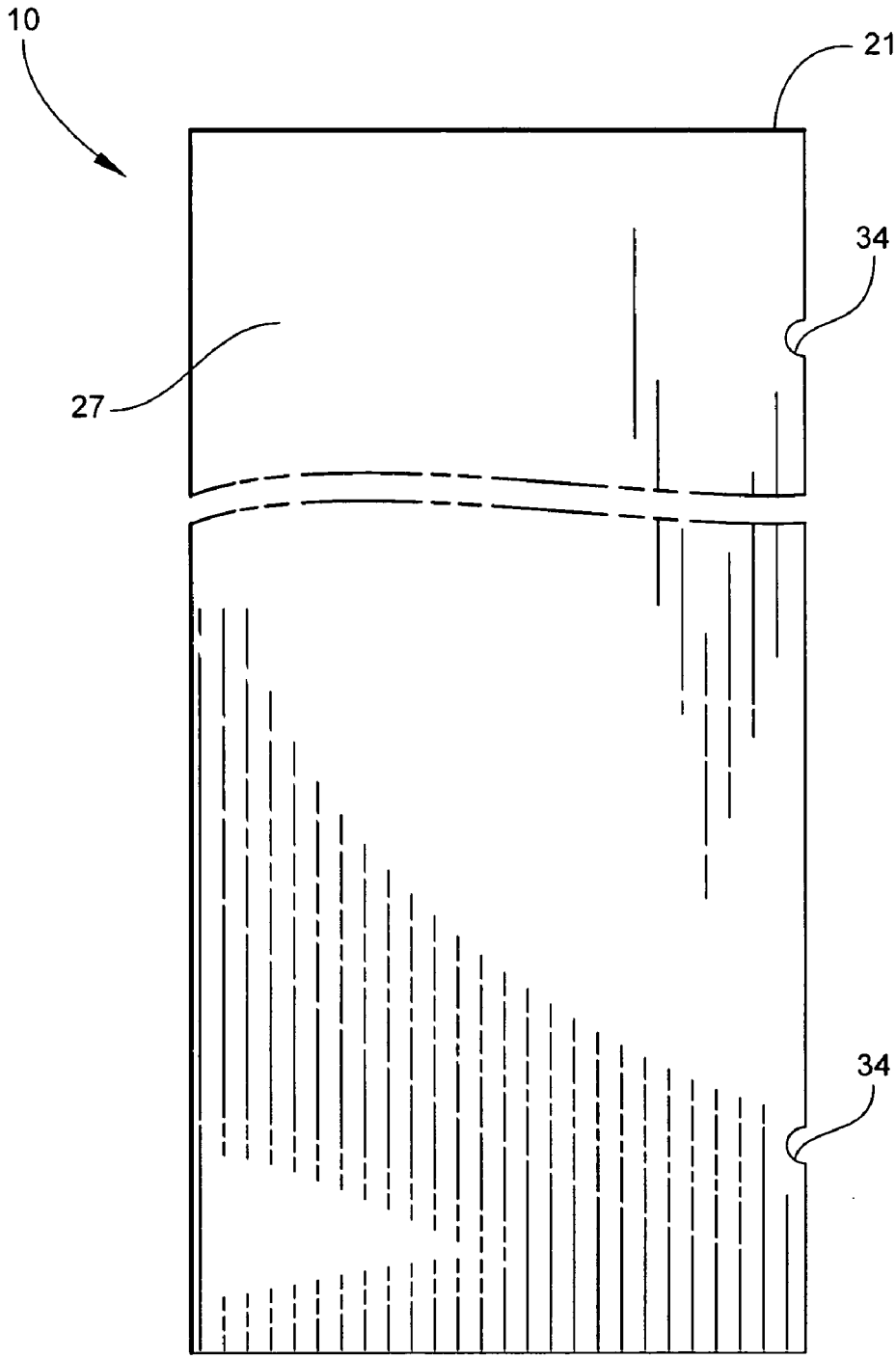
FIG. 6 shows an underside of the flash pan.
Figure 7:
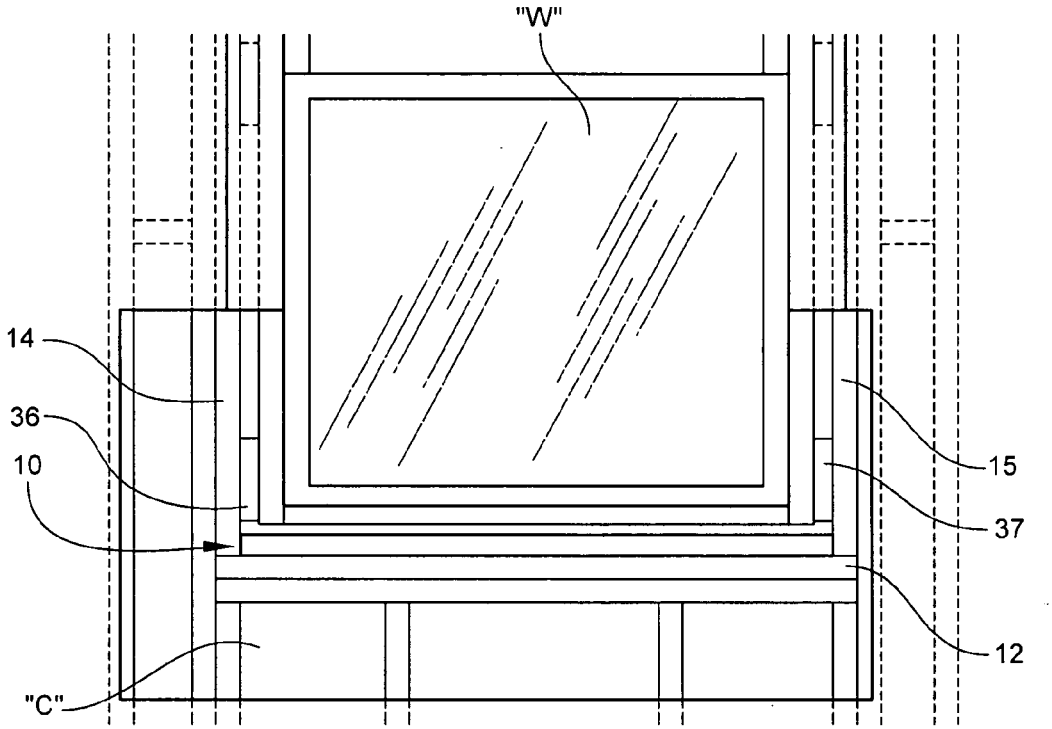
FIG. 7 is a view of a window frame assembly from inside the home with the flash pan installed and the trim removed.
Figure 8:
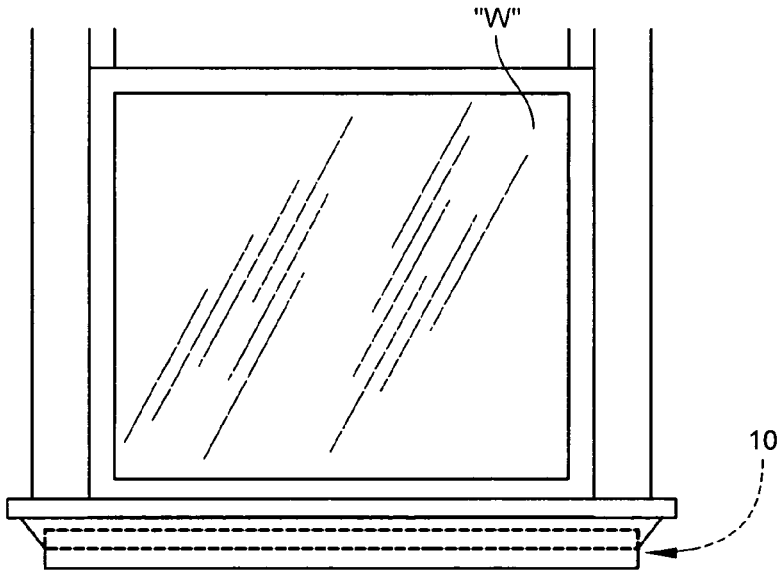
FIG. 8 is a view of the window frame assembly with the flash pan installed and shown in phantom behind the attached trim.

Referring now specifically to the drawings, a low-profile flash pan according to the present invention is illustrated in FIG. 1, and shown generally at reference numeral 10. The flash pan 10 is especially applicable for installation below an existing window "W" or other access opening of a residential home. The flash pan 10 operates to collect water infiltrating the window opening, and to distribute this water safely away from an adjacent interior wall cavity "C" of the home. As best shown in FIGS. 1, 2, and 7, the window "W" has a sloped sill 11 which extends adjacent a horizontal framing member 12 (or "rough sill"), and between spaced-apart vertical framing members 14 and 15 (or "jack studs"). The present flash pan 10 resides in a small gap 20 formed between the window sill 11 and the horizontal rough sill 12.

Referring to FIGS. 3, 4, 5, and 6, the flash pan 10 includes a low-profile base 21 having opposing longitudinal inside and outside edges 22 and 23, opposing lateral end edges 24 and 25, and top and bottom major surfaces 26 and 27. The profile height of the base 21 is preferably no greater than 0.5 inches. The width of the base 21 measured from the inside edge 22 to the outside edge 23 is approximately 4-5 inches. The inside edge 22 resides nearest the interior of the home, while the outside edge 23 resides nearest the exterior. A number of closely-spaced feeder channels 31 are formed with the top major surface 26, and extend laterally from the inside edge 22 towards the outside edge 23. The feeder channels 31 capture water which would otherwise infiltrate the interior wall cavity "C" at the joints of the rough sill 12 and jack studs 14, 15 (See FIG. 7). These areas of the rough window opening are generally not sealed, and are responsible for approximately 80% to 90% of all water leakage into the wall cavity "C".

A longitudinal collection channel 32 extends between the inside and outside edges 22, 23 of the base 21, and communicates with the feeder channels 31 to receive and distribute water captured by the flash pan 10. The leading end 31A of each feeder channel 31 is tapered and relatively shallow, whereas the trailing end 31B is rounded and deeper to prevent water flow over the outside edge 23 of the base 31. As best shown in FIG. 4, the depth of the feeder channels 31 gradually increase from opposing leading and trailing ends 31A, 31B inwardly towards the collection channel 32. From the collection channel 32, water is distributed to one or more longitudinally-spaced drain channels 33. The drain channels 33 communicate with the collection channel 32, as best shown in FIGS. 3, 5, and 10, and extend outwardly towards the outside edge 23 of the base 21 where the water is discharged away from the wall cavity "C". Each drain channel 33 has a drip notch 34, best shown in FIG. 6, formed with the outside edge 23 of the base 21 to allow application of appropriate flashing and/or trim 35 (See FIGS. 9 and 10).

Installation of the Flash Pan

Referring to FIGS. 1-2 and 7-10, the flash pan 10 is readily and conveniently installed either during or after construction. Installation may be made from either the interior or the exterior of the home. For retrofit installation, the installer first removes existing wood trim or outside cladding located at the base of the window "W" to expose the gap 20 between the sloped window sill 11 and the rough sill 12, as best shown in FIGS. 1 and 2. The vertical distance from the rear of the window sill 11 to the rough sill 12 is generally between 0.5 to 1.5 inches tapering towards the front of the window sill 11. If necessary, any portion of the vertical window jambs 36, 37 extending into the gap 20 may be removed in order to position the flash pan 10 directly against the vertical jack studs 14, 15 (See FIGS. 7 and 8).

Figure 9:
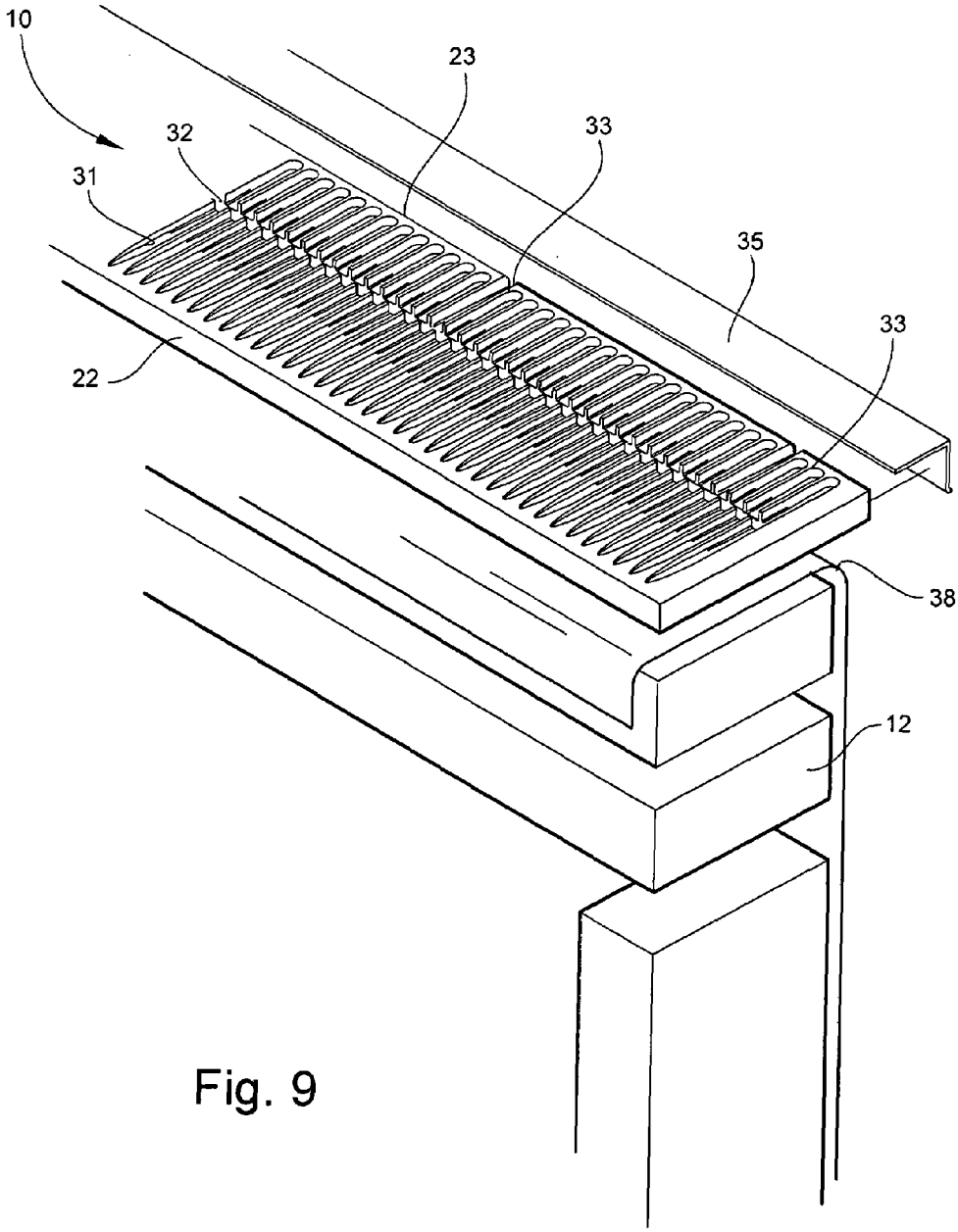
FIG. 9 is an enlarged, exploded view of the flash pan and fragmentary portions of the window frame assembly.
Figure 10:
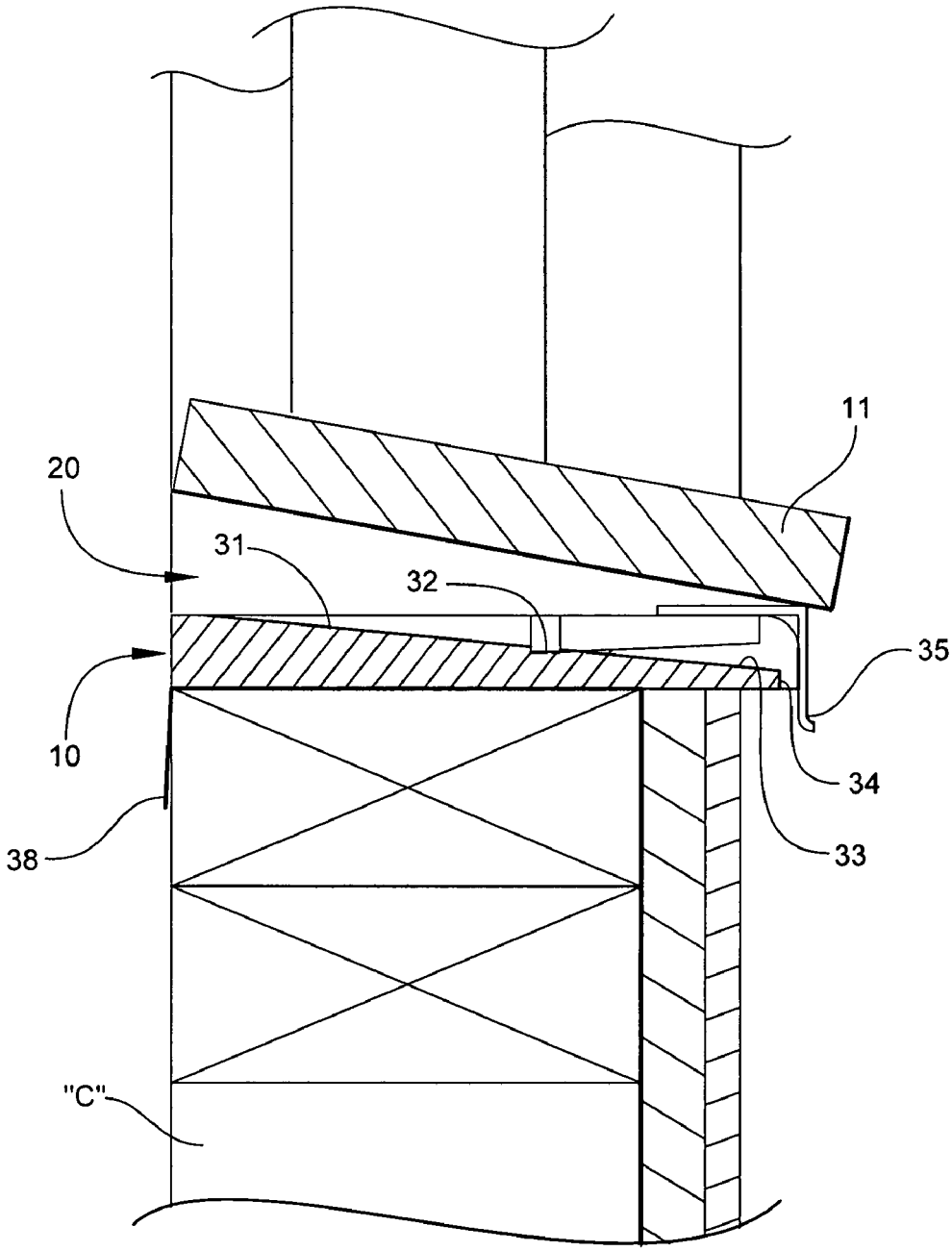
FIG. 10 is an enlarged, cross-sectional view showing the flash pan installed in the window frame assembly.

As shown in FIGS. 9 and 10, the flash pan 10 sits on the horizontal rough sill 12 directly over the exterior vapor barrier 38 penetrating the rough window opening. Any plastic barrier applied to the jack studs 14, 15 is cut to overlap the end edges 24, 25 of the base 21, thereby directing infiltrating water into the flash pan 10. The outside edge 23 of the flash pan 10 extends slightly beyond the rough sill 12, and is covered by the trim/flashing 35. Water collected by the flash pan 10 enters the feeder channels 31 and is gravity-fed inwardly to the longitudinal collection channel 32 where it gathers and moves outwardly through the drain channels 33. The water is ultimately discharged outside of the wall cavity "C" through respective notched ends 34 of the drain channels 33.

A low-profile flash pan and window frame assembly are described above. Various details of the invention may be changed without departing from its scope. Furthermore, the foregoing description of the preferred embodiment of the invention and best mode for practicing the invention are provided for the purpose of illustration only and not for the purpose of limitation-the invention being defined by the claims.

We claim:

1. In a window frame assembly comprising spaced-apart vertical framing members and horizontal top and bottom framing member cooperating to define a window opening, a flash pan adapted for collecting and distributing water infiltrating a building at said window opening, said flash pan comprising:

a low-profile base located within a gap formed beneath said window opening between a window sill and the bottom horizontal framing member, said base having opposing longitudinal inside and outside edges, opposing lateral end edges, and top and bottom major surfaces;

a plurality of feeder channels formed with the top major surface of said base, and extending laterally from the inside edge towards the outside edge, said feeder channels having respective leading and trailing ends adapted for carrying water, and the leading and trailing ends of each feeder channel being divided from respective leading and trailing ends of adjacent feeder channels, and each feeder channel having a variable depth between the leading and trailing ends, the depth being greater at the trailing end thereof and lesser at the leading end thereof;

a longitudinal collection channel formed between the inside and outside edges of said base, and extending longitudinally between the opposing end edges of said base and between respective leading and trailing ends of said plurality of feeder channels, and said collection channel communication with said plurality of feeder channels for receiving water flowing from respective leading and trailing ends of said feeder channels; and a drain channel communicating with said collection channel, and extending outwardly towards the outside edge of said base, whereby water collecting in said feeder channels flows to said collection channel and drains from said base through said drain channel.

2. A flash pan according to claim 1, wherein respective leading and trailing ends of said feeder channels slope inwardly towards said collection channel to promote gravity flow of water into said collection channel.

3. A window frame assembly according to claim 2, wherein said flash pan comprises a plurality of drain channels communicating with said collection channel, and adapted for distributing water away from said base.

4. A window frame assembly according to claim 1, wherein the outside edge of said base defines a drip notch located at an exit end of the drain channel.

5. A window frame assembly according to claim 1, wherein said base of said flash pan has a profile height of no more than 0.5 inches.

6. A window frame assembly according to claim 1, wherein said collection channel of said flash pan has a depth greater than 33% of a profile height of said base.

7. A window frame assembly according to claim 1, wherein said collection channel of said flash pan extends substantially parallel to the inside and outside edges of said base.

8. A window frame assembly according to claim 1, wherein said feeder channels of said flash pan extend substantially perpendicular to said collection channel.

9. A window frame assembly according to claim 1, wherein said drain channel of said flash pan extends substantially perpendicular to said collection channel.

* * * * *